US005873475A

United States Patent [19]

Volpe

[11] Patent Number: 5,873,475

[45] Date of Patent: Feb. 23, 1999

[54] CONTAINER CLOSURE WHICH CONVERTS FROM A CHILD RESISTANT TO A NON-CHILD RESISTANT CONFIGURATION

[75] Inventor: Anthony S. Volpe, Philadelphia, Pa.

[73] Assignee: Volpe and Koenig, P.C., Philadelphia, Pa.

[21] Appl. No.: 97,073

[22] Filed: Jun. 12, 1998

Related U.S. Application Data

[63] Continuation of Ser. No. 759,422, Dec. 5, 1996, Pat. No. 5,769,252.

[51] Int. Cl.[6] ..... B65D 55/14

[52] U.S. Cl. ..... 215/207; 215/201; 215/216; 215/230; 215/250; 220/210; 220/284

[58] Field of Search ..... 215/201, 200, 215/207, 215–221, 250, 252, 254, 256, 230; 220/210, 284

[56] References Cited

U.S. PATENT DOCUMENTS

| | | | |
|---|---|---|---|
| 2,414,420 | 1/1947 | Sebell | 215/230 X |
| 2,443,181 | 6/1948 | Beeson | 215/302 X |
| 3,097,756 | 7/1963 | Dorsey . | |
| 3,138,277 | 6/1964 | Milbourne . | |
| 3,160,301 | 12/1964 | Milbourne | 215/219 |
| 3,233,769 | 2/1966 | Jessop . | |
| 3,276,612 | 10/1966 | Caldwell | 215/215 |
| 3,311,247 | 3/1967 | Rigor . | |
| 3,370,731 | 2/1968 | Ehrbar | 215/215 |
| 3,396,864 | 8/1968 | Jones et al. . | |
| 3,426,932 | 2/1969 | Rouse . | |
| 3,447,709 | 6/1969 | Marasco . | |
| 3,526,332 | 9/1970 | Adelberger et al. . | |
| 3,615,036 | 10/1971 | Mross | 220/210 |
| 3,625,387 | 12/1971 | Schaefer | 215/215 |
| 3,750,817 | 8/1973 | Bozek . | |
| 3,777,924 | 12/1973 | Kayser et al. . | |
| 3,811,590 | 5/1974 | Hall, Jr. . | |
| 3,830,392 | 8/1974 | Kessler et al. | 215/216 |
| 3,893,581 | 7/1975 | Kapphalm . | |
| 3,950,917 | 4/1976 | Choksi et al. . | |
| 4,095,718 | 6/1978 | Kong . | |
| 4,281,771 | 8/1981 | Siegel . | |
| 4,285,437 | 8/1981 | Morris . | |
| 4,393,976 | 7/1983 | Maguire . | |
| 4,413,742 | 11/1983 | Sandhaus . | |
| 4,519,517 | 5/1985 | Walter . | |
| 4,555,035 | 11/1985 | Davis . | |
| 4,629,081 | 12/1986 | McLaren . | |
| 4,723,685 | 2/1988 | Fillmore et al. . | |
| 4,854,459 | 8/1989 | DeJonge | 215/220 |
| 5,147,052 | 9/1992 | Minette . | |
| 5,246,123 | 9/1993 | Kramer et al. | 215/220 |
| 5,509,550 | 4/1996 | DeJonge . | |
| 5,769,252 | 6/1998 | Volpe | 215/221 |

*Primary Examiner*—Stephen K. Cronin
*Assistant Examiner*—Robin A. Hylton
*Attorney, Agent, or Firm*—Volpe and Koenig, P.C.

[57] ABSTRACT

A container closure which can be converted from a child resistant configuration to a non-child resistant configuration. The container closure includes an external cap, an internal cap and a locking element. The locking element is inserted between the external cap and internal cap to form the non-child resistant configuration.

10 Claims, 5 Drawing Sheets

CONTAINER CLOSURE WHICH CONVERTS FROM A CHILD RESISTANT TO A NON-CHILD RESISTANT CONFIGURATION

This application is a continuation of U.S. patent application Ser. No. 08/759,422 filed Dec. 5, 1996 now U.S. Pat. No. 5,769,252.

BACKGROUND OF THE INVENTION

1. Field of the Invention

This invention relates to a child resistant closure. More particularly, it concerns a closure which can be converted from a child resistant to a non-child resistant configuration. While in its child resistant configuration, this closure provides an obstacle to a child attempting to remove the closure from a container. After conversion to a non-child resistant configuration, the closure may be readily removed.

2. Description of the Prior Art

Many types of child resistant closures are known in the art. Their common objective is to provide a closure that is too difficult for small children to open, yet easily opened by adults. While many child resistant closures effectively prevent child access, they also present a problem for adults who lack the manual dexterity or strength to remove the closures. This commonly arises in the case of people suffering from arthritis.

This problem was addressed in U.S. Pat. No. 4,406,376, which discloses a snap on closure which when installed in a first position is child resistant, but when reversed is easily removed by adults. This was not, however, readily adaptable to closures which are rotatably engaged upon containers.

U.S. Pat. No. 4,731,512 also addressed this problem in the context of a rotatably engaged closure. However, the disclosed closure system requires an external instrument when used by adults who lack the manual dexterity or strength required to operate the closure and even then still requires pressure be applied to the external cap.

U.S. Pat. No. RE29,779 discloses a child resistant container using a reversible cap which uses a snap action to open and close the closure.

SUMMARY OF THE INVENTION

The present invention provides a solution to the problem of convertible child resistant closures by utilizing an internal sealing cap with a compliant external cap that is freely rotatable about the interior cap as its child resistant feature. Attached to the external cap is a tamper evident band. To maintain its child resistant feature, the tamper evident band is removed and discarded. In the child resistant configuration, closure removal is accomplished by squeezing the external compliant cap so that an inwardly depending projection on the external cap is mated with a complementary depression on the inner cap. The mating of the projection in the depression creates the necessary cooperation between the caps to permit unscrewing of the internal cap.

To permanently convert the closure to its non-child resistant configuration, a portion of the tamper evident band is severed along a score line and inserted through an aperture in the external cap into the space existing between the internal and external caps. The portion of the tamper evident band rests between the internal and external caps and provides permanent cooperation between the caps without any external force. As an additional safety feature, a sticker which discloses a warning or otherwise indicates that the cap has been rendered non-child resistant is provided to be placed over the aperture.

DESCRIPTION OF THE PREFERRED EMBODIMENTS

Figure 1:
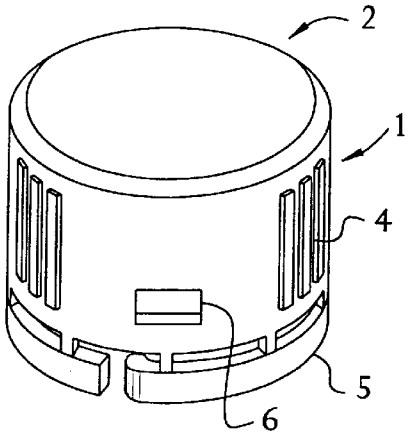
FIG. 1 is a perspective view of a first embodiment of the invention.
Figure 2:
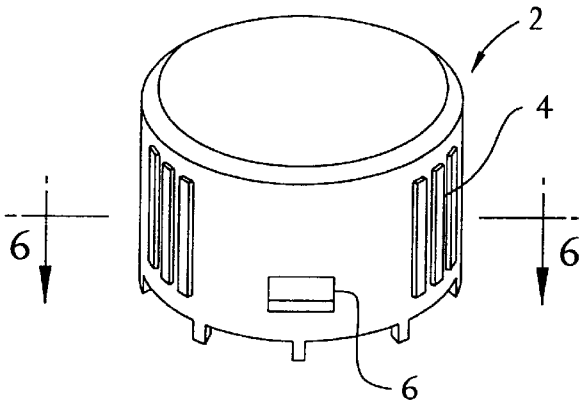
FIG. 2 is a perspective view of the first embodiment of the invention with the tamper evident band removed.
Figure 3:
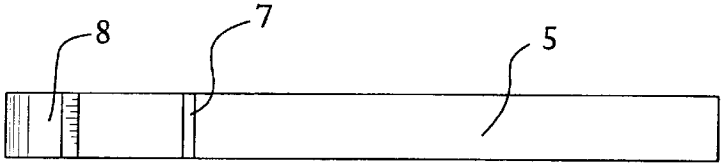
FIG. 3 is a plan view of the tamper evident band.
Figure 4:
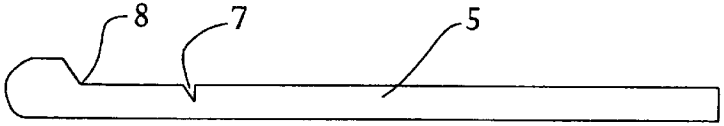
FIG. 4 is a top view of the tamper evident band.
Figure 5:
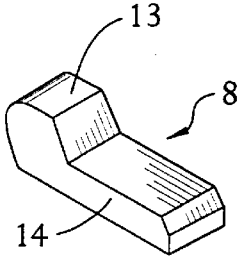
FIG. 5 is a perspective view of the severed portion of the tamper evident band.
Figure 6:
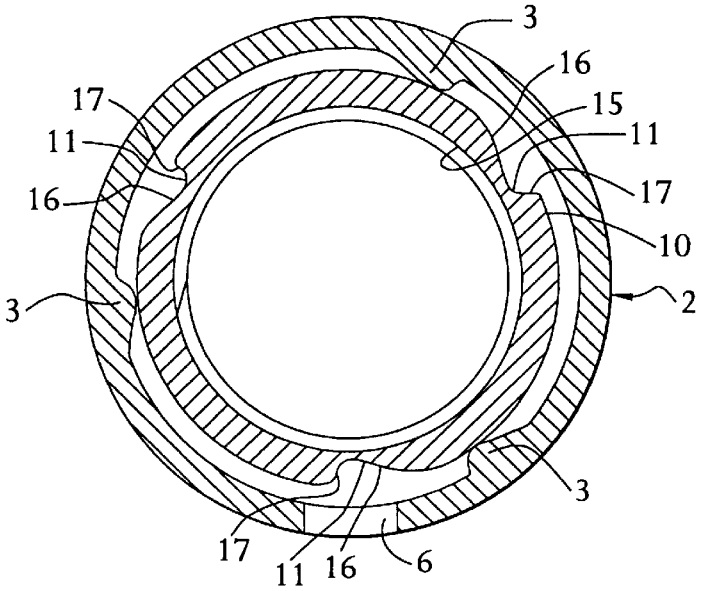
FIG. 6 is a section view taken along line 6—6 of FIG. 2.

Referring to FIG. 1, a first embodiment of the convertible closure 1 is shown. The details of the closure 1 are further illustrated in FIGS. 2–8. A compliant external cap 2 is rotatably mounted about an internal cap 10. The external cap 2 has an aperture 6 that allows access to the space existing between the internal and external caps 10 and 2. Attached to the bottom of the external cap 2 is a removable tamper evident band 5. The gripping surface of the external cap 2 is textured or has raised ridges 4.

The internal cap 10 has a threaded interior 15 designed to match a mating container (not shown). The exterior of the internal cap 10 contains at least one depression 11, each depression comprises two distinct surfaces 16 and 17. The leading surface 16 in the direction of rotation required for removal drops gradually from the exterior surface of the internal cap 10, while the trailing surface 17 makes a steep return. Preferably, an equal number of complementary inward projections 3 protrude from the inside of the external cap 2.

As can be seen by those skilled in the art, in the child resistant configuration, the external cap 2 will rotate easily about the internal cap 10 in the direction required for removal, with the projections 3 being unable to gain sufficient purchase on the leading surfaces 16 of the depressions 11 due to the gradual slope and the flexing of the compliant external cap 2. In order to remove the closure 1, the external cap 2 is squeezed with is sufficient inward pressure for the projections 3 to gain sufficient purchase on the gradually sloped leading surfaces 16 to achieve the necessary cooperation required for unscrewing. The projections 3 on the external cap 2 readily engage the steeply sloped trailing surface 17 of the depressions 11 on the internal cap 10, allowing easy installation of the closure 1 on the mating container.

Figure 7:
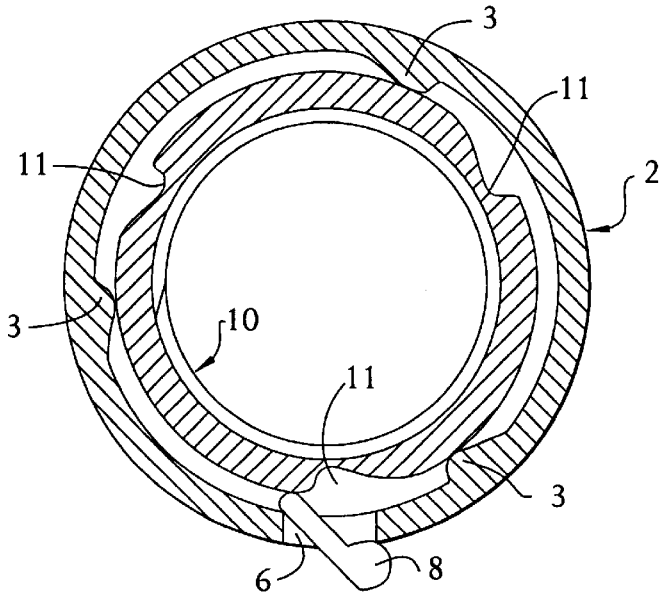
FIG. 7 is a section view showing the installation of the severed portion of the tamper evident band between the inner and outer caps.
Figure 8:
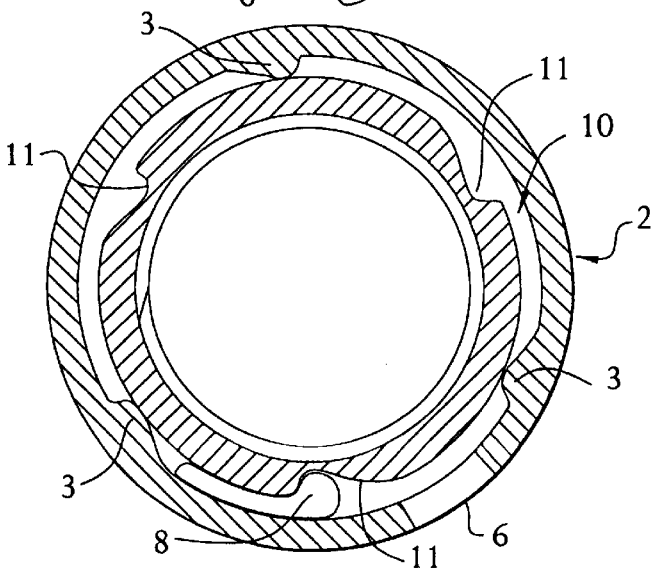
FIG. 8 is a section view showing the severed portion of the tamper evident band installed between the inner and outer caps.
Figure 9:
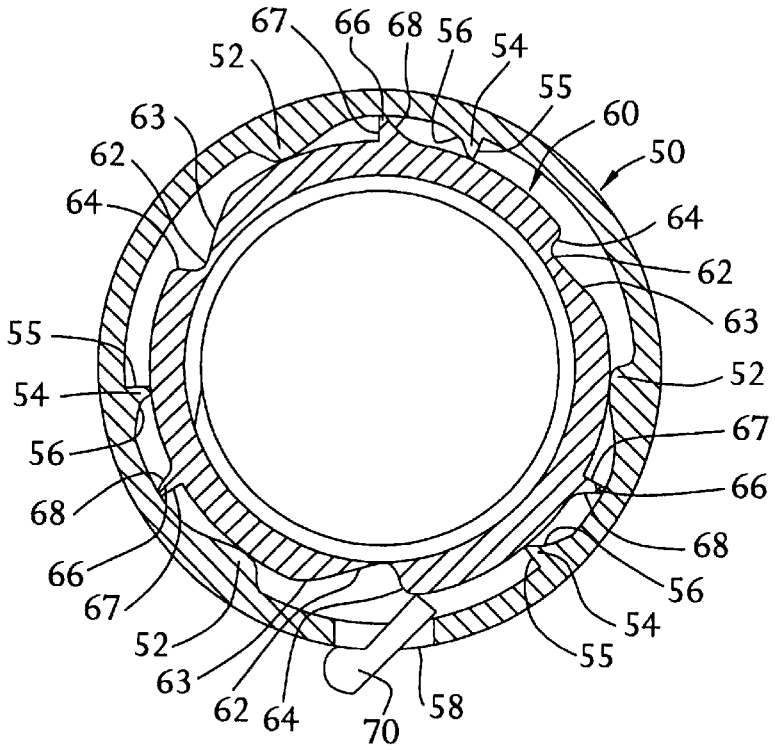
FIG. 9 is a section view of a second embodiment showing the installation of the severed portion of the tamper evident band between the inner and outer caps of the second embodiment.
Figure 10:
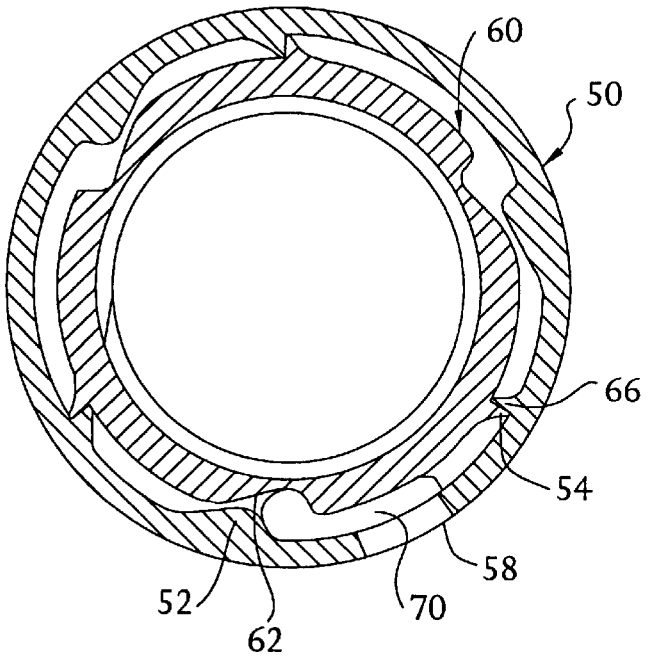
Figure 11:
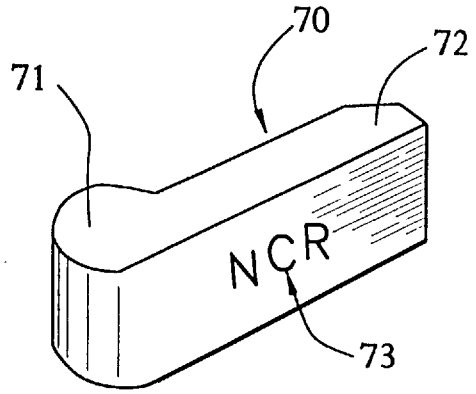
FIG. 11 is a perspective view of the severed portion of the tamper evident band of the second embodiment.
Figure 12:
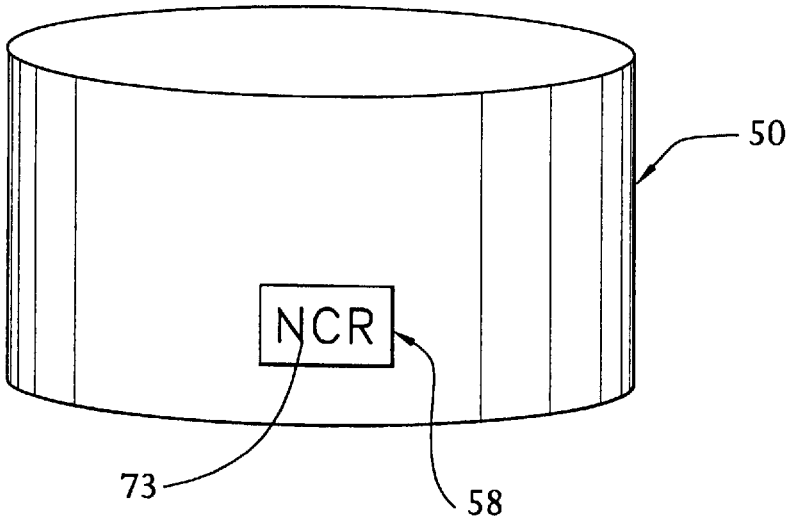
FIG. 12 is a perspective view of the second embodiment of the invention with the non-child resistant indicator showing through the aperture.

To convert the closure 1 to a non-child resistant configuration, a locking element 8 is removed from tamper evident band 5 by severing it along score line 7. The locking element 8 is comprised of a head portion 13 and a tail 14. As shown in FIGS. 7 and 8, after aligning one of the depressions 11 in the inner cap 10 with the aperture 6 in the external cap 2, the tail 14 of locking element 8 is inserted in the opposite direction as the rotation required for cap removal through the aperture 6 into the space existing between the internal and external caps 10 and 2 such that the head portion 13 rests in the depression 11. With the locking element 8 in place, the closure 1 can be removed without squeezing as the locking element 8 provides the necessary cooperation between the internal and external caps 10 and 2. A sticker 20 can be placed on the closure 1 to warn that it has been rendered non-child resistant.

Referring to FIGS. 9–12, a second embodiment of the present invention is shown. The outer and inner caps 50 and 60 of the second embodiment are substantially the same as in the first embodiment. However, the depressions 62 are formed in the opposite direction as in the first embodiment such that, the leading edge 64 in the direction of rotation to remove the closure 48 drops steeply, while the trailing edge 63 makes a gradual return. The external cap 50 again has inward projections 52 which compliment the depressions 62.

Additionally, the outer surface of the internal cap 60 has a number of fingers 66 which have a leading surface 67 in the direction of removal of the closure which is substantially perpendicular to the surface of the internal cap 60 and a trailing surface 68 which is gradually sloped. The inner surface of the external cap 50 has corresponding fingers 54 which have a gradually sloped leading surface 56 in the direction of removal of the closure, and a trailing surface 55 which is substantially perpendicular to the surface of the external cap 50.

In the child resistant configuration, the second embodiment operates in a similar manner as in the first embodiment. The fingers 54 and 66 keep the external and internal caps 50 and 56 spaced apart such that, without any pressure being applied to the external cap, the projections 52 do not mate with the depressions 62. The sloped surfaces 56 and 68 of the fingers allow the fingers 54 and 66 to slip past one another in the direction of removal. Therefore, the external cap 50 will rotate easily about the internal cap 60 in the direction required for removal. In order to remove the closure 48, the external cap 50 is squeezed with sufficient inward pressure for the projections 52 to mate with the depressions 62 and achieve the necessary cooperation required for unscrewing. The perpendicular surfaces 55 and 67 of the fingers 54 and 66 readily engage one another, allowing easy installation of the closure 48 on the mating container.

As in the first embodiment, to convert the second embodiment to a non-child resistant configuration, a locking element 70 is removed from the tamper evident band. The locking element 70 is again comprised of a head portion 71 and a tail portion 72. The tail portion 72 has an indicator 73 which, when inserted into the closure 48, indicates that the device has been rendered non-child resistant. In this embodiment, the tail 72 of the locking element 70 is inserted in the aperture 58 in the same direction as the rotation required for cap removal. After insertion of the locking element 70 through the aperture 58 and a slight rotation of the external cap 50, an inward projection 52 comes into contact with the headed portion 71 of the locking element 70 and the substantially perpendicular surfaces 55 and 57 of the fingers 54 and 66 come in contact with each other, thereby creating an essentially permanent contact between the internal and external caps 60 and 50. Additionally, in this configuration, the aperture 58 is aligned with the indicator 73 so that the warning is observable. A keyed legend on the label warns that the closure is non-child resistant when the indicator 73 is exposed.

Figure 13:
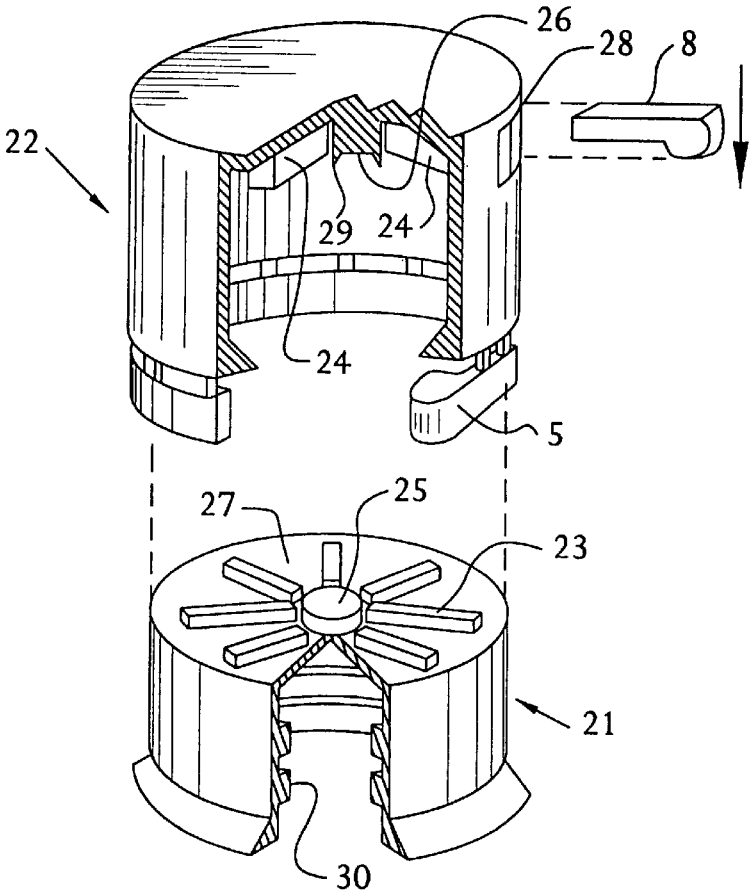
FIG. 13 is a cut away perspective view of a third embodiment of the invention.
Figure 14:
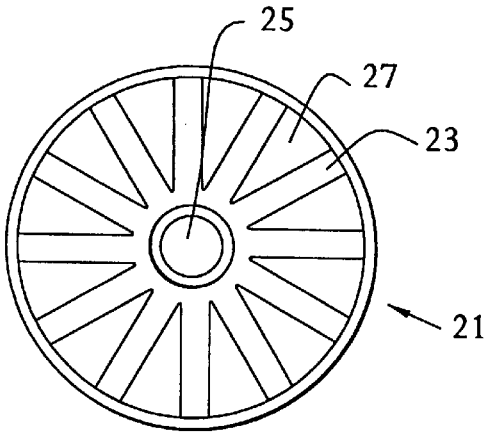
FIG. 14 is a top view of the inner cap of the third embodiment of the invention.
Figure 15:
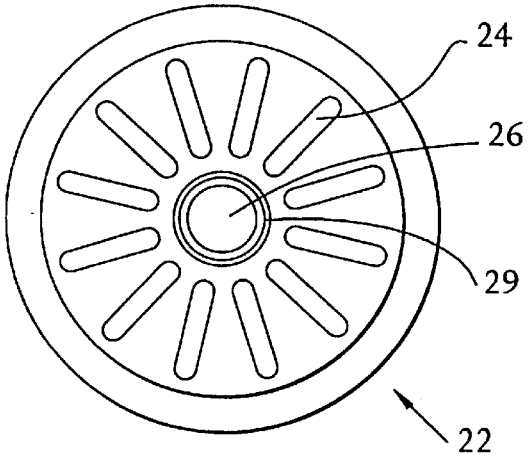
FIG. 15 is a bottom view of the external cap of the third embodiment of the invention.

Referring to FIGS. 13–15, a third embodiment of the present invention is shown. In the third embodiment, "a push down and turn to open" child resistant closure 32 is shown. As can be seen, the internal cap 21 has a threaded interior 30 and radially dispersed rectangular cleats 23 and a button 25 supported by an upper surface 27. Overlying the internal cap 21 is a rotatable, external compliant cap 22 from which opposing, radially dispersed rectangular cleats 24 and opposing button 26 depend. Opposing button 26 and button 25, are centered with respect to the axis of rotation between the external and internal caps 22 and 21, and button 26 has a protruding rim 29 which surrounds the periphery of button 25.

Operation of the child resistant closure requires a motion to push down the external cap 22 onto the internal cap 21 while simultaneously twisting the external cap 22 in either an opening or closing direction.

Fixed to the bottom edge of the external cap 22 is a tamper evident band 5 as previously disclosed. Similar to the application in the first two embodiments, to convert the third embodiment to a non-child resistant configuration, a locking element 8 is removed from tamper evident band 5 by severing it along score line 7. The locking element 8 is comprised of a head portion 13 and a tail portion 14. The tail 14 of locking element 8 is inserted in aperture 28 between the internal and external caps 21 and 22 such that the head portion 13 is approximately flush with the outer surface of external cap 22. Tail portion 14 of locking element 8 creates a barrier between rectangular cleats 24 on the external cap 22 with the rectangular cleats 23 on the inner cap 21. No external push motion is required to engage rectangular cleats 23 with rectangular cleats 24 because the barrier created by locking element 8 engagingly pushes rectangular cleats 23 of the inner cap 21 when rotational movement of rectangular cleats 24 of external cap 22 exists. The portion of head portion 13 which is flush with the outer surface of the external cap 22 can be made to indicate that the closure 32 is non-child resistant, i.e. through the use of warning letters or a warning color. Alternatively, a warning sticker could be placed over the aperture 28.

Numerous alterations of the structure herein disclosed will suggest themselves to those skilled in the art. However, it is understood that the present disclosure relates to preferred embodiments of the invention for the purposes of illustration only and not to be construed as limitation of the invention. All such modifications which do not depart from the spirit of the invention are intended to be included within the scope of the appended claims.

I claim:

1. A container closure which converts from a child resistant to a non-child resistant configuration, the closure comprising:

an inner member having an interior configured to mate with a container and a patterned exterior;

an outer member which overlies the inner member and has a patterned interior which interfaces with the inner member patterned exterior such that it complements the inner member patterned exterior in a first direction of rotation and slips past the inner member patterned exterior in a second direction of rotation, said outer member further includes an aperture through to the interface of the respective exterior and interior patterns; and a locking element which is inserted through the aperture into a permanent, non-accessible position in the interface between said patterned surfaces and permanently eliminates slippage in the second direction and renders the closure non-child resistant.

2. The container closure according to claim 1, wherein the locking element is detachably affixed to the external cap.

3. The container closure according to claim 1 wherein the outer member patterned interior includes a projection which engages said inner member patterned exterior.

4. The container closure according to claim 1 wherein the inner member patterned exterior includes a depression which is engaged by said outer member patterned interior.

5. The container closure according to claim 4 wherein said depression has a steeply sloped trailing surface and a gradual sloped leading surface.

6. The container closure according to claim 4 wherein said depression has a steeply sloped leading surface and a gradual sloped trailing surface.

7. The container closure according to claim 1 wherein a warning indicator is exposed through said aperture when the locking element is placed in the interface.

8. The container closure according to claim 1 wherein said patterned exterior of said inner member and said patterned interior of said outer member possess cleats.

9. The container closure according to claim 8 wherein said cleats are rectangular.

10. The container closure according to claim 1 wherein the locking element is part of a tamper evident band which is removably attached to the closure.

* * * * *